US007146664B1

(12) United States Patent
Grosvenor

(10) Patent No.: US 7,146,664 B1
(45) Date of Patent: Dec. 12, 2006

(54) PNEUMATIC SURGICAL PRONE HEAD SUPPORT AND SYSTEM

(76) Inventor: Eugene M. Grosvenor, 5 Ali Marie Ct., Windsor Mill, MD (US) 21244-1809

( * ) Notice: Subject to any disclaimer, the term of this patent is extended or adjusted under 35 U.S.C. 154(b) by 43 days.

(21) Appl. No.: 10/893,330

(22) Filed: Jul. 19, 2004

(51) Int. Cl.
*A61G 13/12* (2006.01)

(52) U.S. Cl. ..... 5/638; 5/644; 5/655.3

(58) Field of Classification Search ..... 5/638, 5/644, 645, 640, 655.3, 654, 710, 713; 128/848, 128/857, 858; 607/109
See application file for complete search history.

(56) References Cited

U.S. PATENT DOCUMENTS

| | | | | | |
|---|---|---|---|---|---|
| 2,047,216 | A | * | 7/1936 | McKesson | 128/202.23 |
| 2,688,142 | A | * | 9/1954 | Jensen | 5/638 |
| 3,605,145 | A | * | 9/1971 | Graebe | 5/706 |
| 3,656,190 | A | * | 4/1972 | Regan et al. | 5/613 |
| 3,694,831 | A | * | 10/1972 | Treace | 5/638 |
| 3,919,730 | A | * | 11/1975 | Regan | 5/710 |
| 4,013,069 | A | | 3/1977 | Hasty | 601/152 |
| 4,054,960 | A | * | 10/1977 | Pettit et al. | 5/631 |
| 4,338,923 | A | | 7/1982 | Gelfer et al. | 601/150 |
| 4,396,010 | A | | 8/1983 | Arkans | 601/152 |
| 4,472,847 | A | | 9/1984 | Gammons et al. | 5/713 |
| 4,504,050 | A | * | 3/1985 | Osborne | 5/637 |
| 4,710,991 | A | * | 12/1987 | Wilmore et al. | 5/637 |
| 4,723,329 | A | * | 2/1988 | Vaccaro | 5/710 |
| 4,752,064 | A | * | 6/1988 | Voss | 5/638 |
| 4,757,983 | A | * | 7/1988 | Ray et al. | 5/637 |
| 4,788,730 | A | | 12/1988 | Bexton | 5/676 |
| 4,918,774 | A | | 4/1990 | Popitz | 5/644 |
| 4,944,059 | A | * | 7/1990 | Wall | 5/631 |
| 4,944,060 | A | | 7/1990 | Peery et al. | 5/713 |
| 4,955,096 | A | | 9/1990 | Gilroy et al. | 5/730 |
| 5,014,681 | A | | 5/1991 | Neeman et al. | 601/152 |
| 5,044,026 | A | * | 9/1991 | Matthews | 5/644 |
| 5,052,068 | A | * | 10/1991 | Graebe | 5/654 |
| 5,186,163 | A | | 2/1993 | Dye | 601/27 |
| 5,220,699 | A | * | 6/1993 | Farris | 5/636 |
| 5,269,035 | A | | 12/1993 | Hartunian | 5/638 |
| 5,287,576 | A | * | 2/1994 | Fraser | 5/637 |
| 5,383,894 | A | | 1/1995 | Dye | 606/201 |
| 5,520,623 | A | * | 5/1996 | Williams | 602/17 |
| 5,613,501 | A | * | 3/1997 | Michelson | 5/637 |
| 5,638,565 | A | * | 6/1997 | Pekar | 5/710 |
| 5,708,999 | A | | 1/1998 | Priolo et al. | 5/644 |
| 5,771,514 | A | | 6/1998 | Wilhoit | 5/644 |
| 5,960,494 | A | | 10/1999 | Gilliland et al. | 5/638 |
| 6,142,844 | A | * | 11/2000 | Klauber | 441/129 |
| 6,151,735 | A | | 11/2000 | Koby et al. | 5/644 |
| 6,154,903 | A | * | 12/2000 | Wai-Chung | 5/632 |
| 6,154,907 | A | * | 12/2000 | Cinquin | 5/713 |
| 6,241,711 | B1 | * | 6/2001 | Weissberg et al. | 604/291 |
| D456,516 | S | * | 4/2002 | Cheshaek et al. | D24/183 |
| 6,374,441 | B1 | * | 4/2002 | Begell | 5/638 |
| 6,427,272 | B1 | | 8/2002 | Yacoub | 5/638 |

(Continued)

*Primary Examiner*—Robert Canfield
*Assistant Examiner*—Gay Ann Spahn
(74) *Attorney, Agent, or Firm*—Rosenberg, Klein & Lee

(57) ABSTRACT

A pneumatic surgical prone head support (100) (100') (100") is provided that includes a support body (110) within which is disposed a pneumatic pressure distribution network (130) that is fluidly coupled to a plurality of inflatable cells (122, 142) disposed on a top surface (1102) of support body (110). The pneumatic pressure distribution network (130) may be fluidly coupled to a pressurization system (200, 200') to provide fluid pressure pulses in a timed sequence in order to sequentially deflate a portion of the inflatable cells (122, 142).

4 Claims, 8 Drawing Sheets

U.S. PATENT DOCUMENTS

| | | | | |
|---|---|---|---|---|
| 6,442,780 | B1 | 9/2002 | Phillips et al. | 5/730 |
| 6,490,737 | B1 * | 12/2002 | Mazzei et al. | 2/410 |
| 6,558,338 | B1 | 5/2003 | Wasserman | 601/152 |
| 6,561,194 | B1 * | 5/2003 | Michelson | 128/845 |
| 6,584,628 | B1 | 7/2003 | Kummer et al. | 5/615 |
| 6,637,058 | B1 | 10/2003 | Lamb | 5/638 |
| 6,718,581 | B1 * | 4/2004 | Riach | 5/632 |
| 6,745,418 | B1 * | 6/2004 | Turner, Jr. | 5/638 |
| 6,842,924 | B1 * | 1/2005 | Walters | 5/637 |
| 6,928,679 | B1 * | 8/2005 | Gross | 5/638 |
| 2002/0007512 | A1 * | 1/2002 | Livingston | 5/640 |
| 2003/0056795 | A1 * | 3/2003 | Michelson | 128/858 |
| 2003/0226207 | A1 * | 12/2003 | Lowenthal | 5/644 |
| 2005/0177946 | A1 * | 8/2005 | Riley | 5/638 |
| 2005/0262638 | A1 * | 12/2005 | Libunao | 5/710 |
| 2006/0150336 | A1 * | 7/2006 | Jackson, III | 5/644 |
| 2006/0150338 | A1 * | 7/2006 | Jackson, III | 5/655.3 |

* cited by examiner

PNEUMATIC SURGICAL PRONE HEAD SUPPORT AND SYSTEM

BACKGROUND OF THE INVENTION

1. Field of the Invention

This invention directs itself to a pneumatic surgical prone head support and a pneumatic surgical prone head support system. In particular, this invention directs itself to a pneumatic surgical prone head support which includes a support body within which is disposed a pneumatic pressure distribution network that is fluidly coupled to a plurality of inflatable cells disposed on a top surface of the support body. Still further, this invention directs itself to a pneumatic surgical prone head support that is intended to be fluidly coupled to a pressurization system to provide fluid pressure pulses in a timed sequence in order to sequentially deflate a portion of the inflatable cells. More in particular, this invention pertains to a pneumatic surgical prone head support system that includes the pneumatic surgical prone head support and a pressurization system coupled thereto, the pressurization system providing a plurality of controlled pressure sources respectively coupled to the main conduits for independently inflating and deflating particular inflatable cells or groups of inflatable cells in a timed sequence. Still further, this invention directs itself to a pneumatic surgical prone head support which includes a support body having a plurality of inflatable cells with a hemispherical contour.

2. Prior Art

In some prior art systems, such as that disclosed in U.S. Pat. No. 5,960,494, a pneumatic surgical prone head support is disclosed which is formed by a pair of inflatable cushions arranged substantially concentrically on the upper surface of a base member. The two inflatable cushions are sequentially deflated in an alternating fashion in order to prevent continuous pressure from being applied to a patient's face. However, the system requires that at least one of the cushions be fully inflated while the other cushion is in the process of being deflated or re-inflated. Thus, there can be no deflation overlap between the inflatable cushions and a specialized pressurization system is required to be coupled to the head support. Further, the arrangement of the cushions on the base member is very limited, and each cushion must support a large area of the patient's face in order to avoid applying high pressure to the contact areas of the patient's face.

SUMMARY OF THE INVENTION

A pneumatic surgical prone head support is provided. The pneumatic surgical prone head support includes a support body having a cavity formed therein and open on at least an upper side of the support body. The upper side opening of the cavity has a size and contour for receiving a patient's eyes, nose and mouth therein. The head support includes a plurality of sets of inflatable cells disposed on an upper side of the support body collectively circumscribing the opening of the cavity. Each of the sets of inflatable cells is formed by a plurality of individual inflatable cells. A pneumatic pressure distribution network is included which is disposed in the support body and has a plurality of main conduits extending outwardly therefrom for respective fluid coupling to controlled pressure sources. The main conduits are respectively coupled in fluid communication to the plurality of sets of inflatable cells for independently inflating and deflating at least a portion of the plurality of sets of inflatable cells. Each of the main conduits has at least one branch conduit coupled in fluid communication between the main conduit and at least one of the individual inflatable cells of a corresponding one of the sets of inflatable cells.

From another aspect, a pneumatic surgical prone head support system is provided which includes a support body having a cavity formed therein and open on at least an upper side of the support body. The upper side opening of the cavity has a size and contour for receiving a patient's eyes, nose and mouth therein. The system includes a plurality of sets of inflatable cells disposed on the upper side of the support body collectively circumscribing the opening of the cavity. Each of the sets of inflatable cells is formed by a plurality of individual inflatable cells. A system includes a pneumatic pressure distribution network disposed in the support body and having a plurality of main conduits extending outwardly therefrom. The main conduits are respectively coupled in fluid communication to the plurality of sets of inflatable cells for independently inflating and deflating at least a portion of the plurality of sets of inflatable cells. Each of the main conduits has at least one branch conduit coupled in fluid communication between the main conduit and at least one of the individual inflatable cells of a corresponding one of the sets of inflatable cells. A pressurization system is also included in the system which is coupled in fluid communication with the plurality of main conduits for providing fluid pressure pulses in a timed sequence thereto.

From yet another aspect, a pneumatic surgical prone head support system is provided which includes a support body having a cavity formed therein and open on at least an upper side of the support body. The upper side opening of the cavity has a size and contour for receiving a patient's eyes, nose and mouth therein. A plurality of tubular inflatable cells is also included in this system and disposed on the upper side of the support body collectively circumscribing the opening of the cavity. This system includes a pneumatic pressure distribution network disposed in the support body and having a plurality of main conduits extending outwardly therefrom for respective fluid coupling to controlled pressure sources. The pressure sources are switched between at least two pressure levels in a predetermined sequence. The main conduits are respectively coupled in fluid communication to the plurality of tubular inflatable cells for independently inflating and deflating at least a portion of the plurality of tubular inflatable cells in correspondence with the predetermined sequence. Each of the main conduits has at least one branch conduit coupled in fluid communication between the main conduit and at least one of the tubular inflatable cells.

DESCRIPTION OF THE PREFERRED EMBODIMENTS

Referring now to FIGS. 1–8, there is shown a pneumatic surgical prone head support system 10 for supporting a patient's head and face during surgical procedures wherein the patient is in a prone position. As will be seen in following paragraphs, pneumatic surgical prone head support system 10 is directed to the concept of avoiding the exertion of continuous pressure on the soft tissues and cartilaginous support structures of a patient's face. The reduction in continuous pressure is achieved through a plurality of inflatable cells 122, 142 which are sequentially deflated and reinflated periodically in a predetermined sequence to thereby avoid a continued interruption of blood flow to soft tissue areas by pressure thereon.

Figure 1:
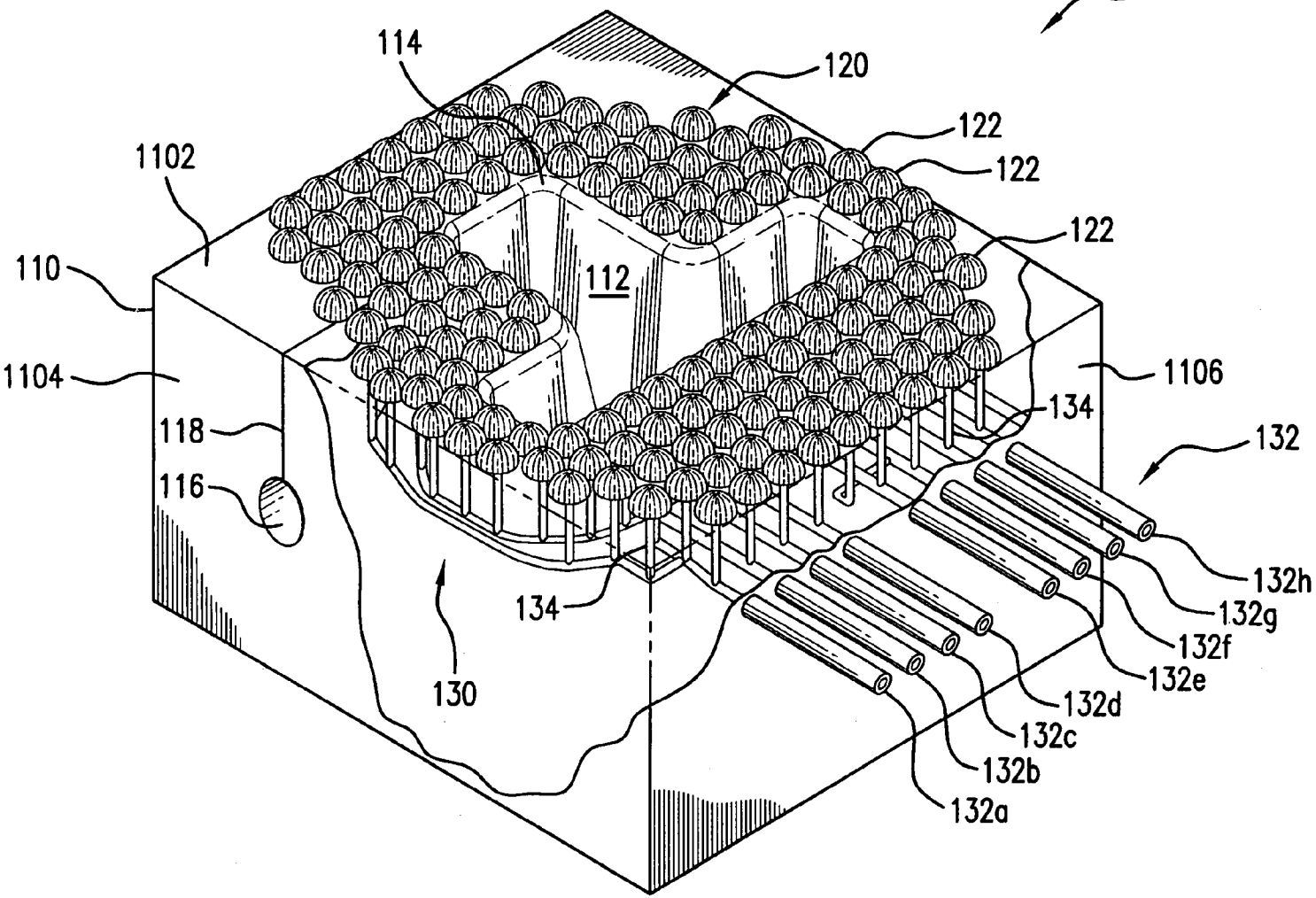
FIG. 1 is a perspective view, partially cut away, of the pneumatic surgical prone head support of the present invention.
Figure 2:
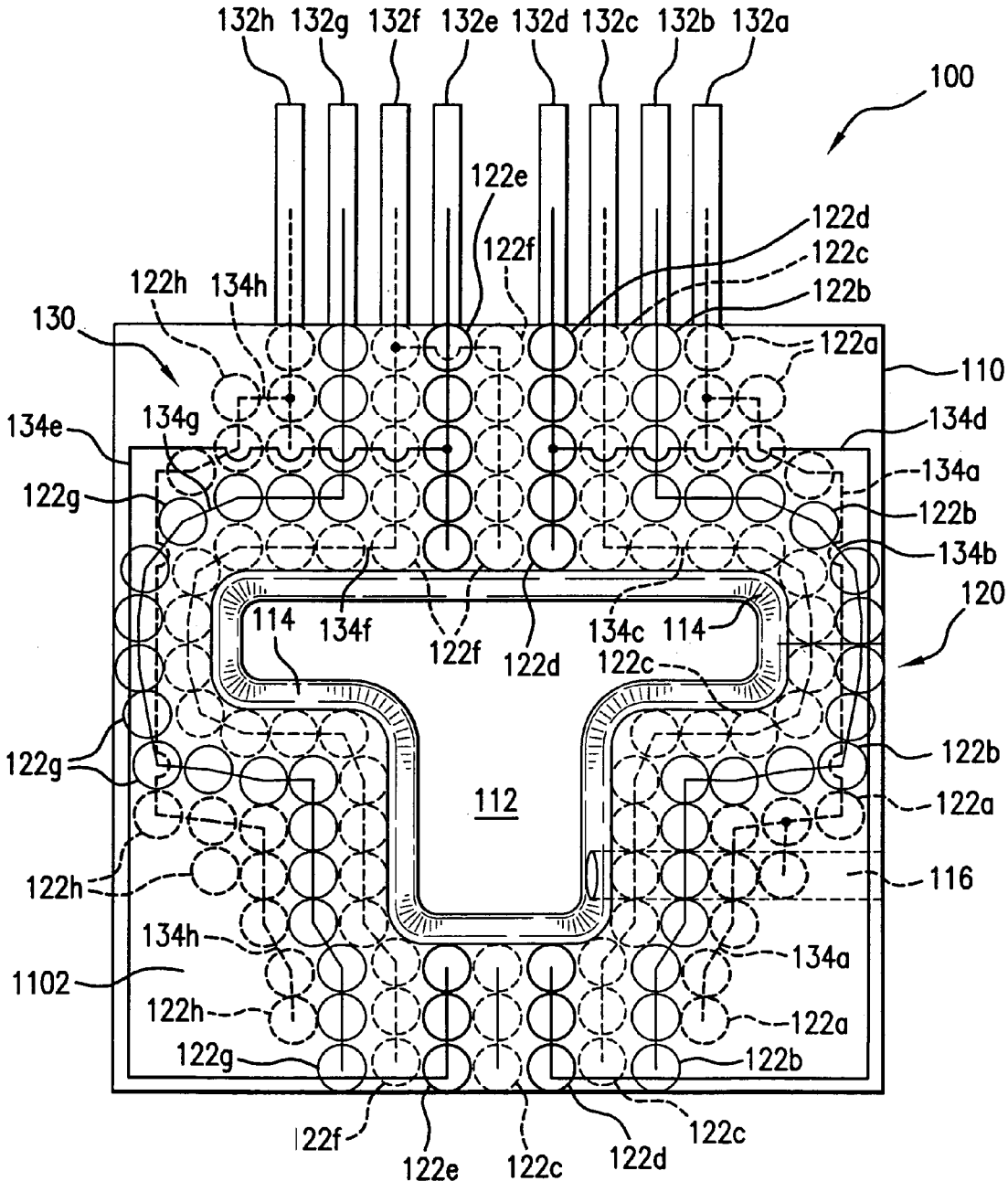
FIG. 2 is a schematic plan view of the head support shown in FIG. 1.

Referring now to FIGS. 1 and 2, there is shown, pneumatic surgical prone head support 100 having a support body 110 formed of a resilient material that is compressed under pressure and is capable of returning to its original configuration upon removal of pressure therefrom. Support body 110 can be formed of a molded, open or closed cell, polymeric material. Polymeric foam materials such as polyurethane, polyethylene, ethylene vinyl acetate, and ethylene propylene diene monomer are all suitable for use in forming support body 110. The support body 110 may be formed of multiple layers of foamed polymeric material, different layers being of different densities, as provided in current surgical prone head supporting devices. However, as support body 110 includes a pneumatic pressure distribution network 130 formed therein, the foam material of support body 110 is best molded around the pneumatic pressure distribution network 130. The pneumatic pressure distribution network 130 could be installed between layers of the foam support body 110, with branch conduits 134 extending through the uppermost layers, such an assembly is labor intensive and less desirable than an in-situ molding method.

Support body 110 has a cavity 112 formed therein that is open to at least the top surface 1102 of support body 110. Cavity 112 is of sufficient size and contour to receive a patient's eyes, nose and mouth therein. The opening of cavity 112 at the top surface 1102 of support body 110 may have a chamfered edge 114 extending about the perimeter of the opening. Extending from one side 1104 of support body 110 is an opening 116 extending therethrough and being in open communication with the cavity 112. A slit 118 extends from the opening 116 to the upper surface 1102 to permit an endotracheal tube to be passed therethrough. While the slit 118 is shown extending to the upper surface 1102 of support body 110, it may alternately be formed so as to extend to the bottom or an adjacent end surface of the support body 110. The upper surface 1102 of support body 110 has a plurality of sets of inflatable cells 120 disposed thereon, each set being defined by a multiplicity of inflatable cells 122 that are inflated and deflated in unison. The plurality of sets of inflatable cells 120 are respectively coupled to the pneumatic pressure distribution network 130. Each inflatable cell 122 has a substantially hemispherical contour. Thus, each cell 122 will form a circular contact area with a patient's face. Since circular areas cannot be completely contiguous, gaps are formed between adjacent cells 122 that correspond to areas of the patient's face that are free of pressure.

Figure 8:
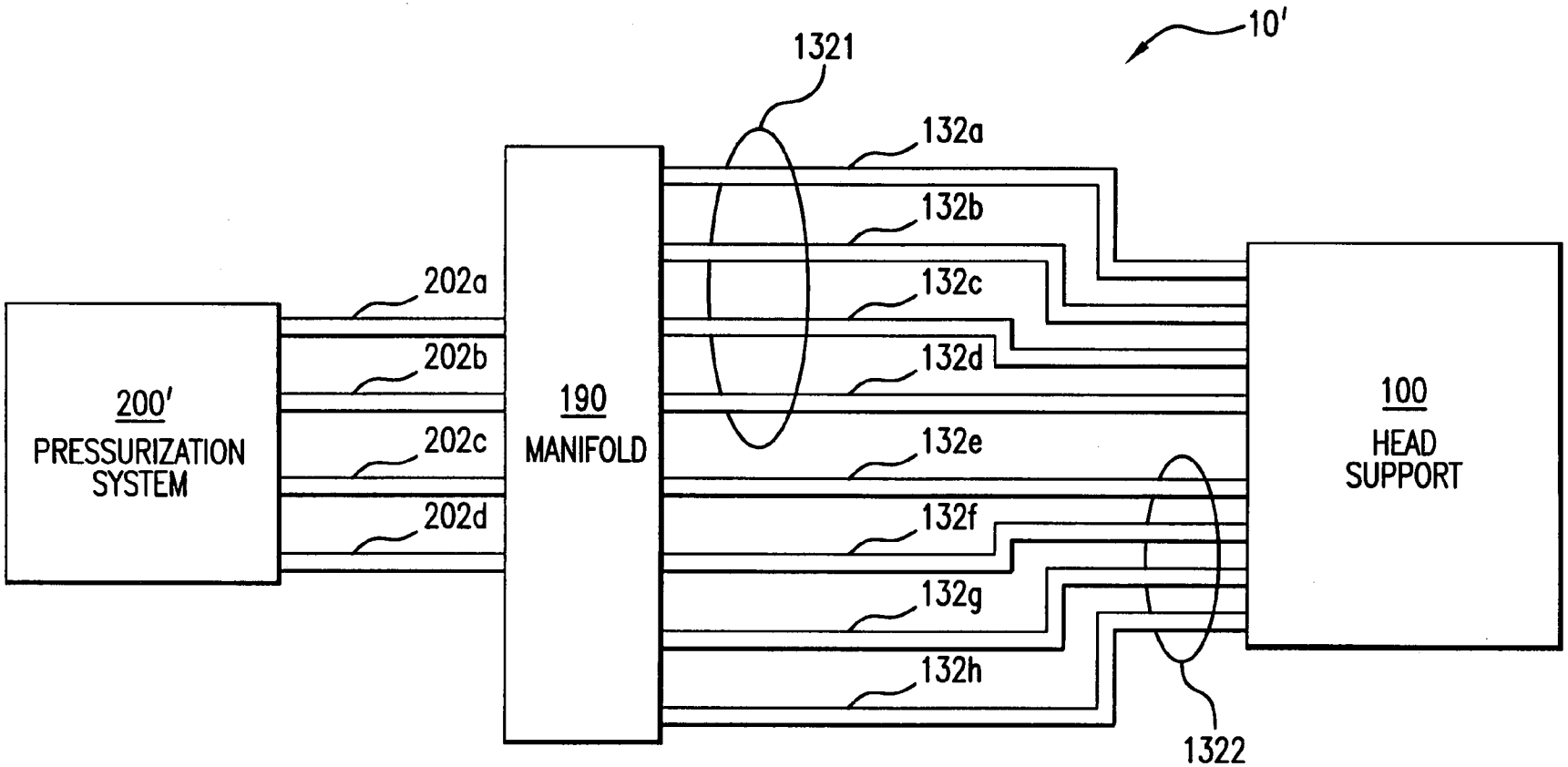

The pneumatic pressure distribution network 130 within the support body 110 includes a plurality of main conduits 132 which extend outwardly from an end 1106 of the support body 110. Each of the main conduits 132*a* through 132*h* are fluidly coupled to corresponding branch conduits 134 to provide fluid distribution from the respective main conduits 132*a* through 132*h* to the individual inflatable cells 122 of each set of inflatable cells. As will be discussed in following paragraphs, the main conduits 132*a* through 132*h* are fluidly coupled to a pressurization system 200, 200', as shown in FIGS. 6 and 8.

Referring more particularly to FIG. 2, the fluid coupling between the plurality of sets of inflatable cells 120 and the pneumatic pressure distribution network 130 is shown. The main conduit 132*a* is coupled to a plurality of inflatable cells 122*a* by fluid coupling through branch conduits 134*a*. Thus each of the plurality of inflatable cells 122*a* are inflated and deflated in unison and define a first set of inflatable cells. The main conduit 132*b* is coupled to a plurality of inflatable cells 122*b* through the branch conduits 134*b*. Thus, the plurality of inflatable cells 122*b* define a second set of inflatable cells that can be inflated and deflated independently of the other sets of inflatable cells. Each of the remaining main conduits 132*c*, 132*d*, 132*e*, 132*f*, 132*g*, and 132*h* are each respectively coupled to a plurality of inflatable cells 122*c*, 122*d*, 122*e*, 122*f*, 122*g*, and 122*h* through corresponding branch conduits 134*c*, 134*d*, 134*e*, 134*f*, 134*g*, and 134*h*, respectively defining third, fourth, fifth, sixth, seventh and eighth sets of inflatable cells.

As can be seen in the figure, the plurality of sets of inflatable cells 120 collectively circumscribe the opening of chamber 112 on the top surface 1102 of the support body 110. The plurality of sets of inflatable cells 120 provide a resilient contact surface for supporting the facial portion of a patient. In order to avoid a constant pressure being applied to the patient's skin for a prolonged period of time, each of the sets, or selected pairs of sets of inflatable cells 120 are periodically deflated so as to relieve the corresponding contact areas of the patient's skin of any pressure. Subsequent inflation of those inflatable cells 122 previously deflated and the deflation of one or more other sets of inflatable cells allows for relief from pressure of other areas of the patient's face corresponding to the now deflated inflatable cells 122.

Figure 6:
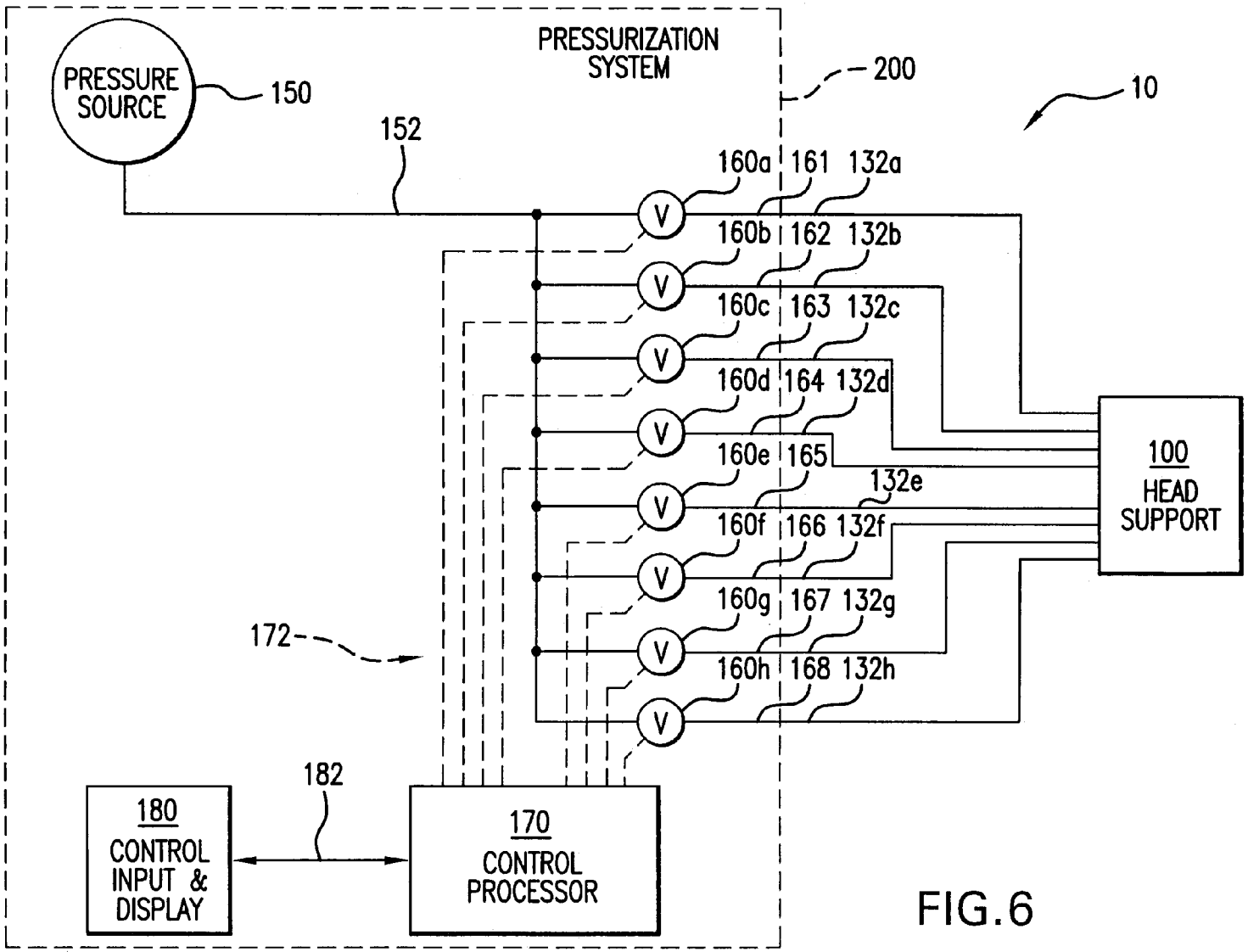
FIG. 6 is a block diagram of the pneumatic surgical prone head support system of the present invention.

Referring now to FIG. 6, such shows pneumatic surgical prone head support system 10 with head support 100 fluidly coupled to controlled pressure sources provided by pressurization system 200. In the configuration illustrated, pressurization system 200 provides eight controlled pressure outlets 161–168 respectively fluidly coupled to the main conduits 132*a*–132*h*. Each outlet 161–168 is coupled to a corresponding three-way valve 160*a*–160*h* which respectively pressurizes the main conduit 132*a*–132*h* and vents or otherwise lowers the pressure to substantially atmospheric pressure responsive to control signals coupled to the valves 160*a*–160*h* from the control processor 170 through the electrical coupling lines 172. Pressurized fluid is supplied to the valves 160*a*–160*h* from a pressure source 150 through a fluid supply manifold 152. The pressurized fluid source 150 may be a compressor or a pressurized bottle source of fluid, such as a compressed gas cylinder containing nitrogen gas, as an example. Although pressurization system 200 is more simply constructed for gaseous fluids, it is not beyond the scope of the present invention to utilize liquids for changing the pressure levels within the plurality of inflatable cells 122.

Figure 7:
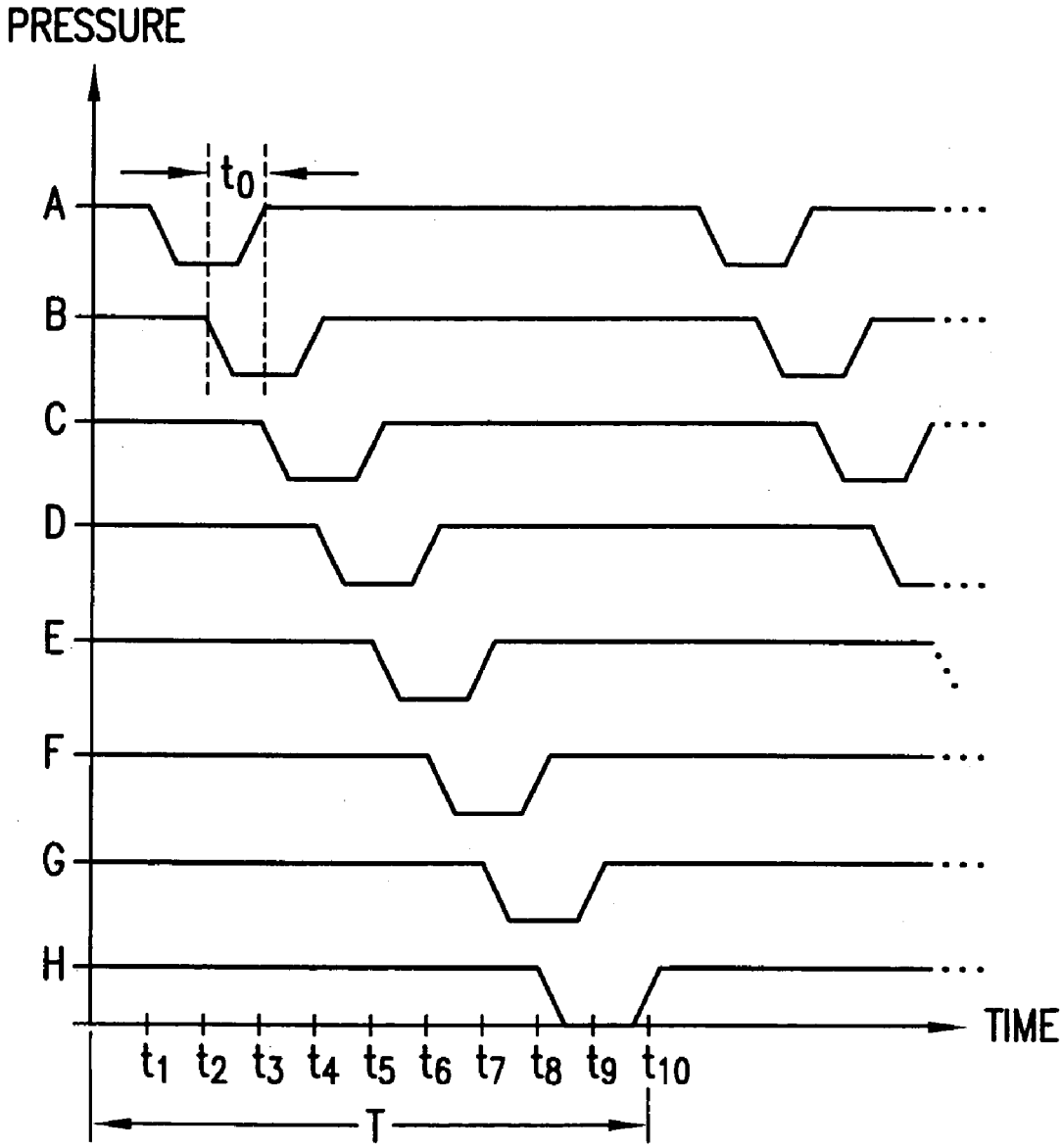
FIG. 7 is a graphical representation of a timed sequence provided by the pressurization system of the present invention; and, FIG. 8 is an alternate configuration of the pneumatic surgical prone head support system of the present invention.

Control processor 170 is coupled to a control input and display unit 180 through a bi-directional electrical coupling 182. Control input and display 180 includes the switches, keyboard, status indicators and/or alphanumeric displays necessary for adjusting the sequence and duty cycle of the valves controlled by control processor 170. Control processor 170 sequentially operates each of the valves 160*a*–160*h* in a predetermined sequence. An exemplary sequence is shown in FIG. 7. Each graph A–H corresponds to the fluid pressure provided at the corresponding output 161–168. Initially, all of the outputs 161–168 are pressurized, being maintained at a pressure greater than atmospheric pressure so that the corresponding inflatable cells 122 are all inflated. At time $t_1$ valve 160*a* is operated to reduce the pressure at output 161 for a predetermined time, until time $t_3$. At time $t_2$ valve 160*b* is operated to reduce the pressure at output 162, as indicated by graph B. Output 162 remains at a lower pressure level until time $t_4$. In the particular example illustrated, there is an overlap time period wherein both outputs 161 and 162 are both at low pressure levels, the corresponding inflatable cells coupled thereto being in a deflated state. The value of the overlap time $t_0$ maybe selected within the range of zero, no overlap, to as much as 75% of the total low pressure time, $t_3$-$t_1$ for example. As is shown, sequentially, each of the outputs 163, 164, 165, 166, 167, 168 is switched to a low pressure state as illustrated in each of the respective graphs C, D, E, F, G, H. With all of the outputs 161 through 168 being pressurized to inflate all of the inflatable cells 122 at time $t_{10}$. The time $t_{10}$ represents the total cycle time T of the depressurization sequence provided by control processor 170, which cycle then repeats for as long as the pneumatic surgical prone head support system 10 is in use.

Although pressurization system 200 has been illustrated to include eight individual pressure outlets 161–168, it should be understood that more or less individual pressure outlets may be utilized to achieve the goal of preventing injury to the patient due to prolonged contact with the head support 100. Minimally, the pressurization system requires at least four individual pressure outlets, each outlet being fluidly coupled to two main conduits 132. The pneumatic surgical prone head support system 10', as shown in FIG. 8, includes pressurization system 200'. Pressurization system 200' includes four outlets 202*a*, 202*b*, 202*c*, and 202*d* that are respectively coupled to a manifold system 190 for selectively pressurizing two groups 1321 and 1322 of main conduits 132 in parallel and corresponding inflate/deflate two groups of the sets of inflatable sets 120 in parallel. Thus, the outlet 202*a* is fluidly coupled to both of main conduits 132*a* and 132*e* in parallel by means of manifold 190. Similarly, main conduits 132*b* and 132*f* are coupled in parallel with the outlet 202*b* and main conduits 132*c* and 132*g* are coupled to the outlet 202*c*. Outlet 202*d* is coupled through manifold 190 to both of main conduits 132*d* and 132*h*. The parallel sets of inflatable cells 120 of head support 100 are disposed in non-adjacency on the upper surface 1102 of the support body 110. While the overall pattern of the parallel operated sets of inflatable cells 120 are substantially non-adjacent to one another, a few of the individual inflatable cells 122 of those sets of inflatable cells 120 may be adjacent to one another. Such adjacent inflatable cells 122 are typically located near the ends of the sets of inflatable cells 120 furthest from the corresponding main conduit 132.

In such an arrangement, the graphs A through D of FIG. 7 would represent the cycling of pressurization provided by a system 200', with the cycle being repeated after time $t_6$. The use of four outlets for operating the plurality of sets of inflatable cells 120 of head support 100 would allow head support 100 to be utilized with the pressure source devices of sequential compression devices. In particular, the air pump devices of sequential compression devices that are programmable, such as those provide by the Kendall Company of Mansfield, Mass. or MEGO AFEK Industrial Measuring Instruments of Afek, Israel may be utilized as a pressure source for head support 100. The pressure sources for sequential compression devices provide for individual outlets that are sequentially pressurized and coupled to respective inflatable bladders that surround respective appendages of a patient, such as both legs. The bladders surrounding each appendage of a patient are coupled to the four outlets of the pressurization source through a manifold such that the bladders in each appendage are operated in parallel. Thus, in place of the two compression sleeves that are normally utilized with such a system, the head support 100 maybe coupled thereto, the eight main conduits 132 being coupled to the manifold of the sequential compression device and the operating sequence of that pressurization device being programmed to provide the sequential depressurization of the plurality of inflatable cells in the manner previously described. Pressurization system 200', having only four independent outlets, can be operated at a sufficiently rapid cycle time and the duty cycle for each individual outlet to provide a massaging effect. Thus, not only will necrosis of the soft tissue be avoided, but in fact circulation to those tissues will be stimulated by the massaging effect.

Figure 3:
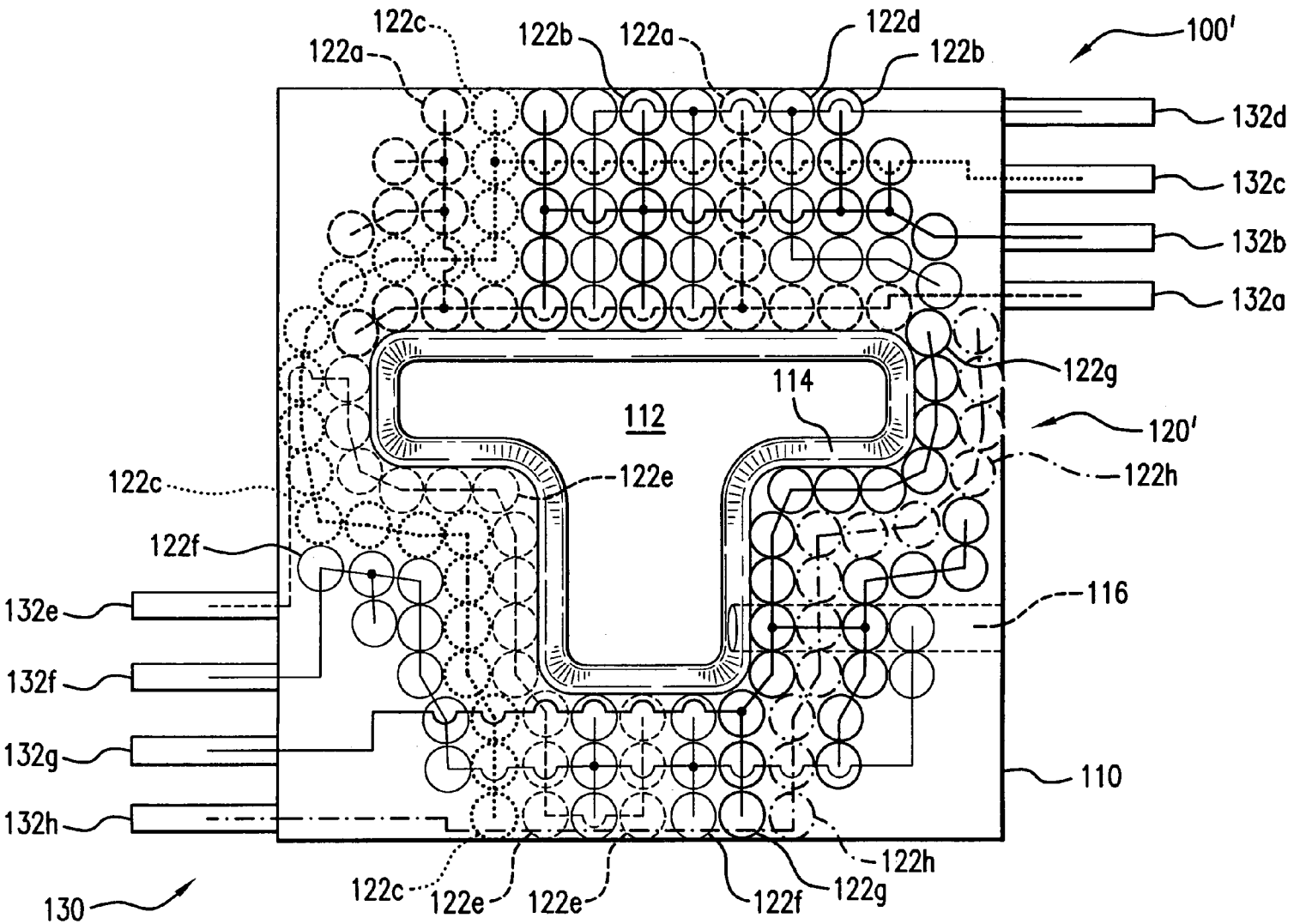
FIG. 3 is a schematic plan view of an alternate configuration of the head support of the present invention.

Referring now to FIG. 3, an alternate configuration of the pneumatic surgical prone head support is shown. Head support 100' differs from head support 100 only as described below. In head support 100', the support body 110 is provided with a pneumatic pressure distribution network 130 wherein the main conduits 132 extend from two sides of the support body 110. That arrangement is particularly important, as the complexity of the pneumatic pressure distribution network 130 is reduced and a more varied arrangement of the inflatable cells 122, so each set of inflatable cells 120 is possible. Thus, the particular inflatable cells 122 coupled to any one main conduit 132*a*–132*h* which form the sets of inflatable cells 120' are positioned differently from the sets of inflatable cells 120 of the head support 100. As shown, the main conduit 132*a* is fluidly coupled to the plurality of inflatable cells 122*a*, the main conduit 132*b* is coupled to the plurality of individual inflatable cells 122*b*, the inflatable cells 122*c* being fluidly coupled to the main conduit 132*c* and the main conduit 132*d* providing fluidic coupling to the plurality of individual cells 122*d*, from one side of the main body 110. The main conduits 132*e*, 132*f*, 132*g*, and 132*h* are disposed on another side of the support body 110 and respectively coupled to the plurality of inflatable cells 122*e*, 122*f*, 122*g*, and 122*h*.

Here again, head support 100' is coupled to a pressurization system 200, 200' for providing the sequential deflation of the inflatable cells, in a sequence wherein individual sets of the plurality of inflatable cells are sequentially deflated, with the patient's face being supported by the remaining inflated inflatable cells. As in the case of the head support 100, when head support 100' is coupled to the pressurization system 200, each of the main conduits 132*a*–132*h* are individually sequentially switched between pressurization levels. When head support 100' is coupled to pressurization system 200', the main conduits 132*a*–132*d* are coupled in parallel with the main conduits 132*e*–132*h* to operate the corresponding sets of inflatable cells 120' in nonadjacent pairs of inflatable cell sets.

Figure 4:
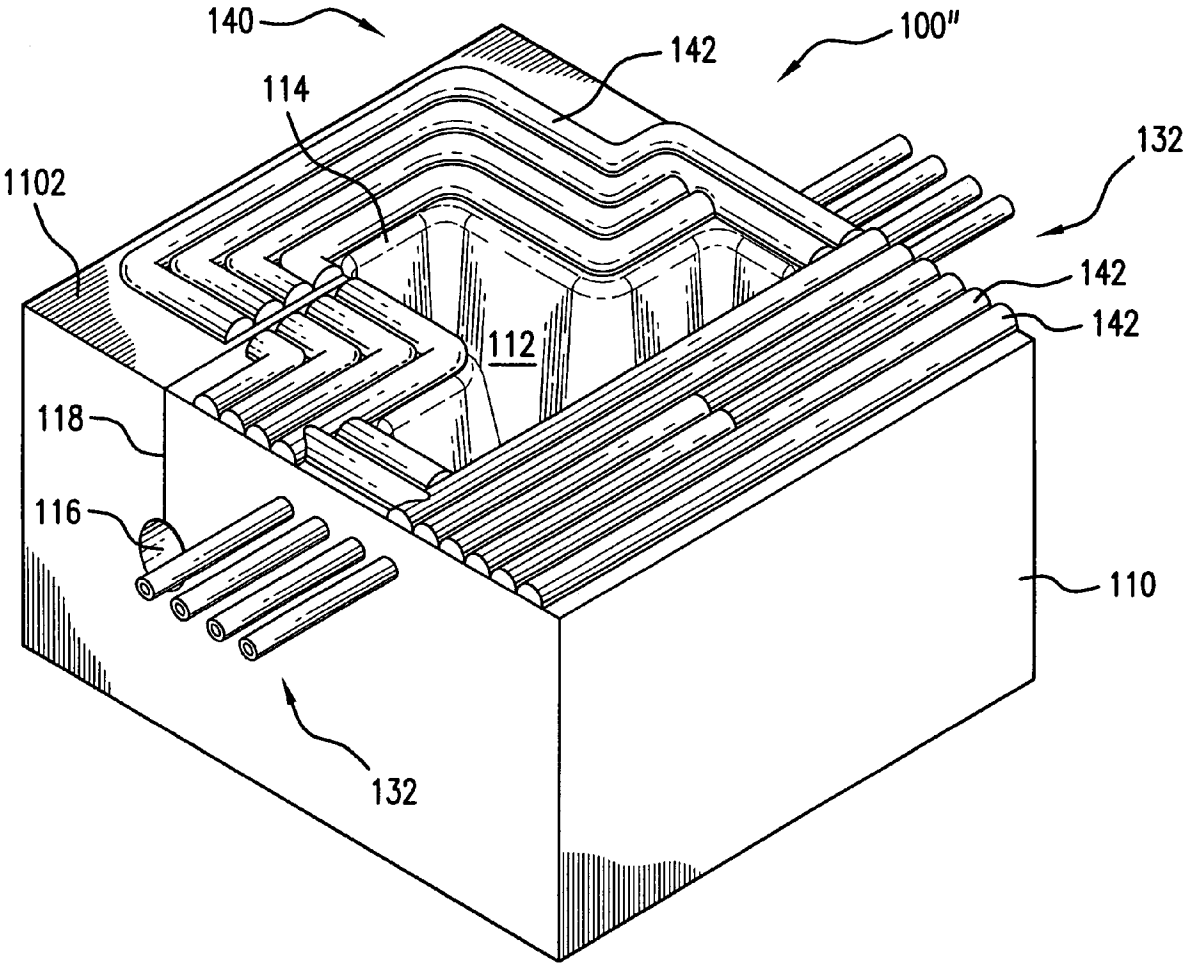
FIG. 4 is a perspective view of another alternate configuration of the head support of the present invention.
Figure 5:
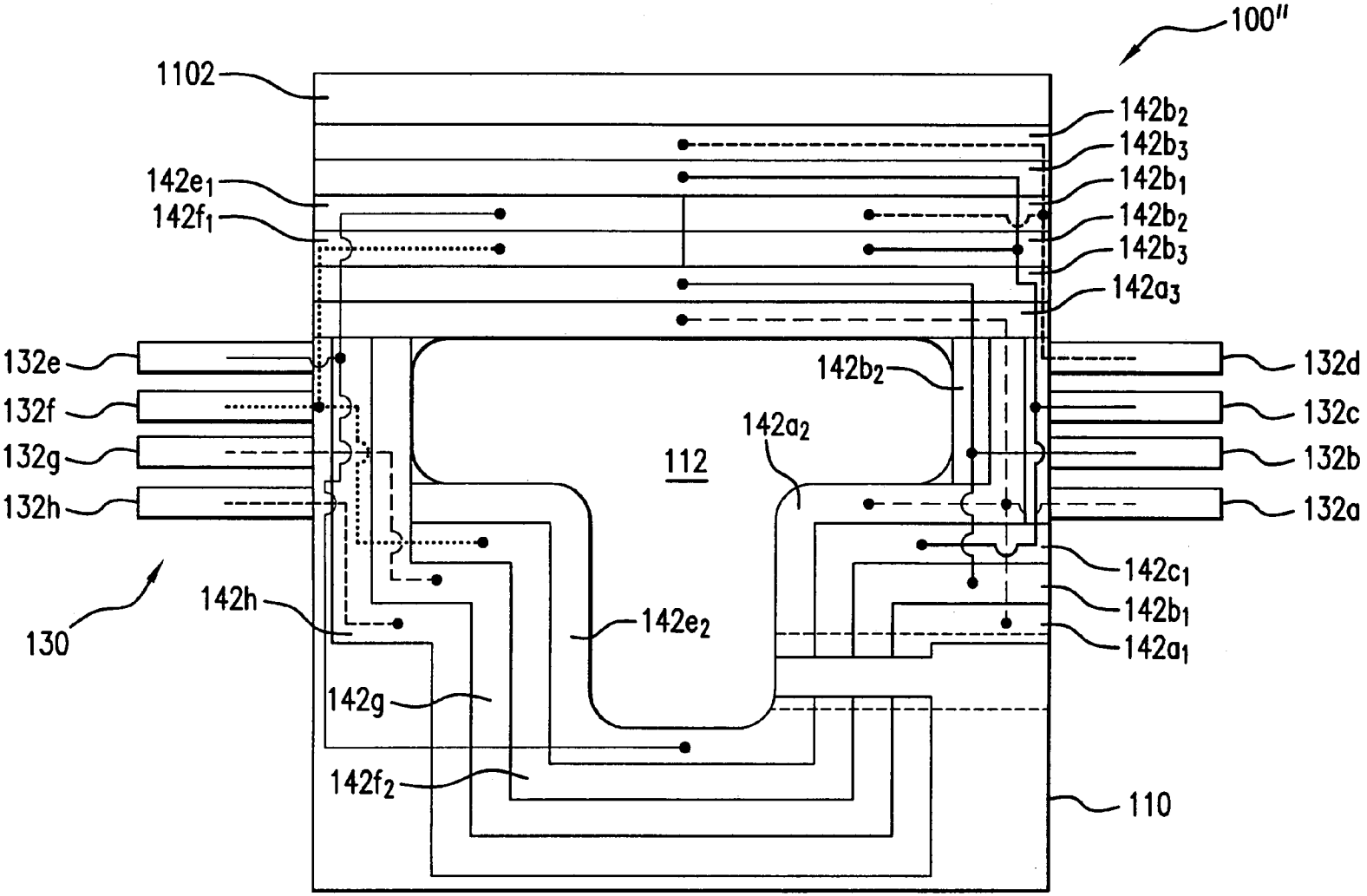
FIG. 5 is a schematic plan view of the head support of FIG. 4.

Referring now to FIGS. 4 and 5, there is shown another configuration of the head support. Head support 100" differs from head support 100 only as described below. Head support 100" utilizes a plurality of tubular inflatable cells 140 disposed on the top surface 1102 of support body 110 and arranged to collectively circumscribe the opening of the cavity 112. The plurality of tubular inflatable cells 140 are fluidly coupled to the pneumatic pressure distribution network 130, the pneumatic pressure distribution network 130 having main conduits 132 extending from two sides of the support body 110.

The main conduit 132*a* is fluidly coupled to three individual tubular inflatable cells 142$a_1$, 142$a_2$, and 142$a_3$. Main conduit 132*b* is also coupled to three tubular inflatable cells

142$b_1$, 142$b_2$, and 142$b_3$. Tubular inflatable cells 142$c_1$, 142$c_2$ and 142$c_3$ are fluidly coupled to the main conduit 132*c*, while main conduit 132*d* is coupled to a tubular inflatable cells 142$d_1$ and 142$d_2$. Tubular inflatable cells 142$e_1$ and 142$e_2$ are both fluidly coupled to the main conduit 132*e*, and main conduit 132*f* is coupled to a pair of tubular inflatable cells 142$f_1$ and 142$f_2$. Each of main conduits 132*g* and 132*h* are respectively fluidly coupled to tubular inflatable cells 142*g* and 142*h*. As in the previously described arrangements of surgical prone head support 100 and 100', head support 100" can be coupled to the pressurization system 200, shown in FIG. 6, or alternately pressurization system 200', through the manifold 190, as shown in FIG. 8 for parallel operation of two groups of the plurality of tubular inflatable cells 140. Other than at end portions thereof, parallel operated tubular inflatable cells 142 are disposed in non-adjacency. As in the prior examples and important to the inventive concepts described herein, head support 100" provides a sufficient number of tubular inflatable cells 142 to permit deflation overlap between sequentially deflated tubular cells 142. Further, the head support 100", like head supports 100 and 100', is able to be operated by a programmable type sequential compression device already in use in operating rooms of many hospitals.

Although this invention has been described in connection with specific forms and embodiments thereof, it will be appreciated that various modifications other than those disclosed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or scope of the invention as defined in the appended claims.

The invention claimed is:

1. A pneumatic surgical prone head support, comprising:

a support body having a cavity formed therein, said cavity having an opening formed on at least an upper side of said support body, said upper side opening of said cavity having a size and contour for receiving a patient's eyes, nose and mouth therein;

a plurality of sets of inflatable cells disposed on said upper side of said support body collectively circumscribing said opening of said cavity, each of said sets of inflatable cells being formed by a plurality of individual inflatable cells, at least two of said plurality of sets of individual inflatable cells extend in a non-linear contour on said upper side of said support body, and at least another two of said plurality of sets of individual inflatable cells being disposed in a discontinuous pattern wherein a first portion of each of said other two sets of individual inflatable cells are spaced from a second portion thereof with individual inflatable cells of other sets of individual inflatable cells being interposed between said first and second portions in a direction in which said plurality of sets of inflatable cells disposed on said upper side of said support body circumscribe said opening of said cavity; and, a pneumatic pressure distribution network disposed in said support body and having a plurality of main conduits extending outwardly therefrom for respective fluid coupling to controlled pressure sources, said main conduits being respectively coupled in fluid communication to said plurality of sets of inflatable cells for independently inflating and deflating at least a portion of said plurality of sets of inflatable cells, each of said main conduits having at least one branch conduit coupled in fluid communication between said main conduit and at least one of said individual inflatable cells of a corresponding one of said sets of inflatable cells.

2. A pneumatic surgical prone head support system, comprising:

a support body having a cavity formed therein, said cavity having an opening formed on at least an upper side of said support body, said upper side opening of said cavity having a size and contour for receiving a patient's eyes, nose and mouth therein;

a plurality of sets of inflatable cells disposed on said upper side of said support body collectively circumscribing said opening of said cavity, each of said sets of inflatable cells being formed by a plurality of individual inflatable cells;

a pneumatic pressure distribution network disposed in said support body and having a plurality of main conduits extending outwardly therefrom, said main conduits being respectively coupled in fluid communication to said plurality of sets of inflatable cells for independently inflating and deflating at least a portion of said plurality of sets of inflatable cells, each of said main conduits having at least one branch conduit coupled in fluid communication between said main conduit and at least one of said individual inflatable cells of a corresponding one of said sets of inflatable cells; and, a pressurization system coupled in fluid communication with said plurality of main conduits for providing fluid pressure to said plurality of sets of inflatable cells, said pressurization system sequentially depressurizing each of said plurality of sets of inflatable cells in a timed sequence, a time period of depressurization of each of said plurality of sets of inflatable cells at least partially overlapping a time period of depressurization of another of said plurality of sets of inflatable cells.

3. The pneumatic surgical prone head support system as recited in claim 2 wherein said sets of inflatable cells are divided into two groups, said main conduits of one group being operated in parallel with said main conduits of the other group to inflate and deflate corresponding pairs of sets of said plurality of sets of inflatable cells.

4. The pneumatic surgical prone head support system as recited in claim 2 wherein at least two of said plurality of sets of individual inflatable cells extend in a non-linear contour on said upper side of said support body, and at least another two of said plurality of sets of individual inflatable cells are disposed in a discontinuous pattern wherein a first portion of each of said other two sets of individual inflatable cells are spaced from a second portion thereof with individual inflatable cells of other sets of individual inflatable cells being interposed between said first and second portions in a direction in which said plurality of sets of inflatable cells disposed on said upper side of said support body circumscribe said opening of said cavity.

* * * * *